United States Patent [19]

Wada et al.

[11] 4,454,076

[45] Jun. 12, 1984

[54] VARIABLE VENTURI CARBURETOR

[75] Inventors: Satomi Wada, Obu; Masanori Senda, Nagoya; Takashi Horii, Aichi; Yozo Ota, Chiryu, all of Japan

[73] Assignee: Aisan Kogyo Kabushiki Kaisha, Obu, Japan

[21] Appl. No.: 454,577

[22] Filed: Dec. 30, 1982

[30] Foreign Application Priority Data

Jan. 8, 1982 [JP] Japan ..... 57-1499[U]

[51] Int. Cl.[3] ..... F02M 9/06

[52] U.S. Cl. ..... 261/44 C; 261/DIG. 56

[58] Field of Search ..... 261/44 C, DIG. 56

[56] References Cited

U.S. PATENT DOCUMENTS

| | | | |
|---|---|---|---|
| 3,424,441 | 1/1969 | Caisley et al. | 261/44 C |
| 3,528,787 | 9/1970 | Hallberg | 261/44 C |
| 4,302,404 | 11/1981 | Nakamura et al. | 261/44 C |

FOREIGN PATENT DOCUMENTS

| | | | |
|---|---|---|---|
| 455482 | 3/1966 | Japan | 261/44 C |
| 55-87842 | 3/1980 | Japan | 261/44 C |

*Primary Examiner*—Tim R. Miles

*Attorney, Agent, or Firm*—Bernhard Kreten

[57] ABSTRACT

Disclosed herein is a variable venturi carburetor including at least one pressure controlling port provided at the lower peripheral portion of the suction piston and adapted to face to a mixing chamber defined directly downstream of the venturi portion. The pressure controlling port is located at such a position as to communicate with the suction chamber and an atmospheric pressure chamber during middle and high intake air flowing stages as the suction piston reciprocates transversely with respect to the venturi portion, and to communicate with the suction chamber and the mixing chamber during low intake air flowing stage.

2 Claims, 13 Drawing Figures

VARIABLE VENTURI CARBURETOR

BACKGROUND OF THE INVENTION

This invention relates to a variable venturi carburetor in an internal combustion engine adapted to prevent self-oscillation of a suction piston installed in the carburetor which self-oscillation will, in turn, cause surge of an automotive body as during acceleration with a throttle valve fully opened at middle and high intake air flowing stages.

Generally in a variable venturi carburetor, as the amount of reciprocating motion of a suction piston is determined by the intake air vacuum at the venturi portion or the throat portion of the associated air intake flow line, the engine power is apt to be influenced by fluctuations in the intake air vacuum. Particularly at high intake air flowing stage as during acceleration with the throttle valve fully opened, a slight level of pressure fluctuations or pulsations generated at the engine or air intake system causes self-oscillation of the suction piston and influences the amount of intake air and fuel flow, thus resulting in surge of the automotive body and unsmooth acceleration performance of the engine.

To prevent undue self-oscillation of the suction piston, an oil damper is conventionally included in the suction chamber. However, in such an oil damper, difference in viscosity of oil and variation in viscosity due to change in temperature tend to arise, thus resulting in unsatisfactory repeatability upon accurate metering of fuel flow in the carburetor. In case of employment of the oil damper for a long period of time, the amount of oil is descreased or the property of oil is changed and as the result, the oil damper may not function satisfactorily.

Another prior art has proposed a countermeasure to cope with such self-oscillation of the suction piston wherein a sliding flange of the suction piston is provided with a pressure controlling port so as to communicate the suction chamber with the ambient air, thereby relieving a direct transmission of sudden change in negative pressure in the venturi portion to the suction chamber. However, according to this prior art, a reciprocating motion of the suction piston may not quickly respond to the change in the negative pressure at acceleration, and accordingly, the response performance of the engine is reduced. In particular, during low intake air flowing stage, the amount of reciprocating motion of the suction piston varies greatly as a result of errors in measurement during manufacture of the pressure controlling port, and thus the air-fuel ratio disadvantageously fluctuates.

SUMMARY OF THE INVENTION

Accordingly, a primary object of the present invention is to provide a variable venturi carburetor which may prevent undue self-oscillation of the suction piston created by fluctuations in intake air vacuum at acceleration with the throttle valve fully opened during middle and high intake air flowing stages.

Another object of the present invention is to provide a variable venturi carburetor which may prevent delay in reciprocating motion of the suction piston which delay is accompanied by the prevention of the self-oscillation of the suction piston to control the reciprocating motion thereof accurately and keep the acceleration performance of the engine in a good condition during low intake air flowing stage.

A further object of the present invention is to provide a variable venturi carburetor which may keep the repeatability in accurate metering of fuel flow constant without installation of any damping device.

According to the present invention, at least one pressure controlling port is provided at the lower peripheral portion of the suction piston and is adapted to face to a mixing chamber defined directly downstream of the venturi portion. The pressure controlling port is located at such a position as to communicate with the suction chamber and an atmospheric pressure chamber during middle and high intake air flowing stages as the suction piston reciprocates transversely, and to communicate with the suction chamber and the mixing chamber during low intake air flowing stage. With this structure of the carburetor, at acceleration with the throttle valve fully opened during middle and high intake air flowing stages, undue self-oscillation of the suction piston created by fluctuations in intake air vacuum is prevented by introduction of ambient air, thus obviating inclination of leanness and fluctuations of an air-fuel ratio accompanied by the self-oscillation.

Since at acceleration during low intake air flowing stage, no ambient air is introduced into the suction chamber, and negative pressure in the mixing chamber is transmitted to the suction chamber, delay in reciprocating motion of the suction piston is prevented and the reciprocating motion thereof is accurately controlled, thereby keeping the acceleration performance of the engine in a good condition.

Since the carburetor of the present invention includes no damping device in the suction chamber, the repeatability in accurate metering of fuel flow may be maintained constant.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENTS

Figure 1:
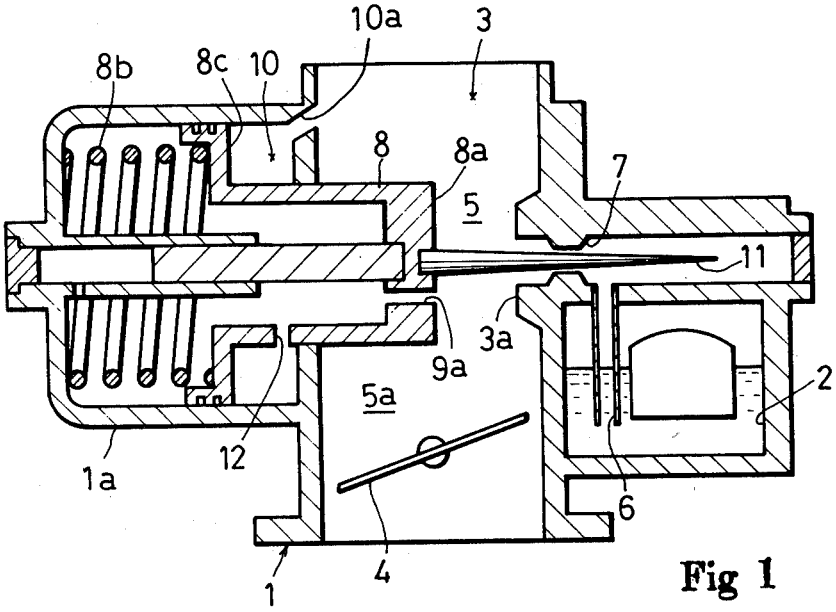
FIG. 1 is a vertical sectional view of the variable venturi carburetor according to the first preferred embodiment of the invention.
Figure 2:
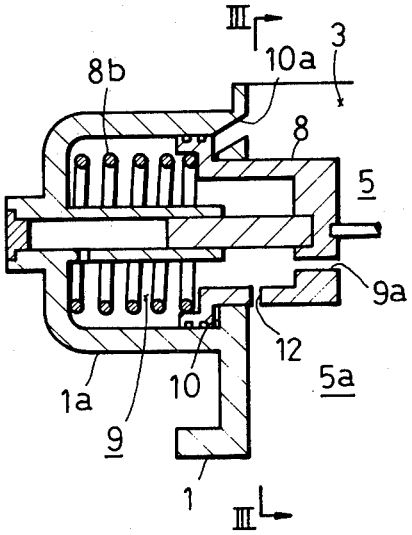
FIG. 2 is a vertical sectional view of the essential part of FIG. 1, illustrating the operation thereof.
Figure 3:
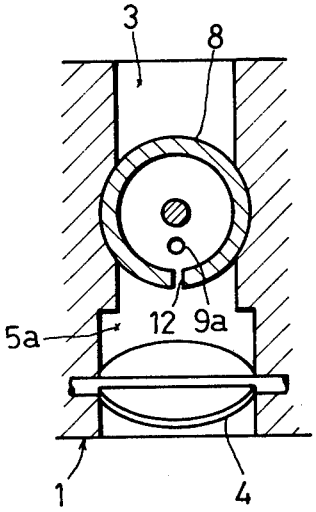
FIG. 3 is a sectional view taken along the line III—III of FIG. 2.

Referring now to FIGS. 1 through 3 which show a variable venturi carburetor according to a first preferred embodiment of the present invention, reference numeral 1 designates a carburetor body of a variable venturi type having a float chamber 2, an air intake passage 3, a throttle valve 4, a venturi portion 5 and a mixing chamber 5*a*. Reference numeral 6 designates a fuel passage communicating with the float chamber 2 and the venturi portion 5. The fuel passage 6 is provided with a fuel jet 7 on the way thereof. The venturi portion 5 is defined upstream of the throttle valve 4 by the inside wall 3*a* of the air intake passage 3 and the right end portion 8*a* of a suction piston 8. A suction chamber 9 is defined by a cylindrical portion 1*a* of the carburetor body 1 and the suction piston 8 slidably inserted into the cylindrical portion 1*a*. A compression spring 8*b* is inserted in the suction chamber 9 and serves to normally urge the suction piston 8 toward the inside wall 3*a* of the air intake passage 3. A vacuum communication port 9*a* is provided at the right end portion 8*a* of the suction piston 8 and is adapted to communicate with the suction chamber 9 and the venturi portion 5. An atmospheric pressure chamber 10 is defined by the sliding flange portion 8*c* of the suction piston 8 and the carburetor body 1 and is provided with an atmospheric pressure communication port 10*a* in the vicinity of the inlet of the air intake passage 3, whereby ambient air is induced through the port 10. A fuel metering needle 11 is fixed to the right end portion 8*a* of the suction piston 8 at its central portion. The free end of the metering needle 11 is laterally reciprocatingly inserted in the interior of the fuel jet 7.

At least one pressure controlling port 12 is provided at the lower peripheral portion of the suction piston 8 and is adapted to face to the mixing chamber 5*a*. The pressure controlling port 12 is so located to communicate with the suction chamber 9 and the atmospheric pressure chamber 10 during middle and high air flowing stages as the suction piston 8 laterally reciprocates as shown in FIG. 1, and to communicate with the suction chamber 9 and the mixing chamber 5*a* during low air flowing stage.

Figure 4:
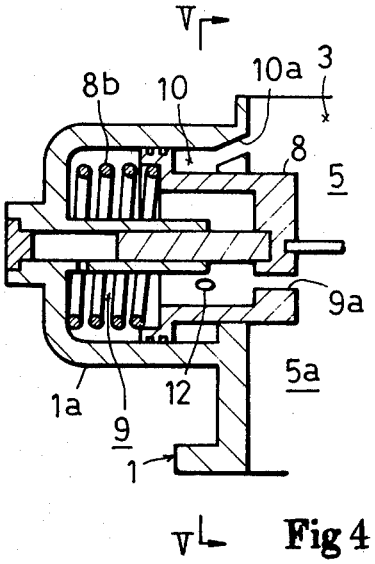
FIGS. 4 and 6 are vertical sectional views of the essential part of the carburetor according to the second preferred embodiment.
Figure 5:
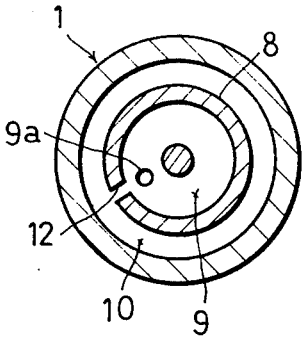
FIGS. 5 and 7 are a sectional view taken along the line V—V of FIG. 4 and a sectional view taken along the line VII—VII of FIG. 6, respectively.

Referring next to FIGS. 4 through 7 which illustrate another preferred embodiment of the present invention wherein the pressure controlling port 12 is provided at the lower peripheral portion of the suction piston 8 at an angle to the induced air flow line. In this embodiment, the pressure controlling port 12 is adapted to communicate with the suction chamber 9 and the atmospheric pressure chamber 10 during middle and high air flowing stages as shown in FIGS. 4 and 5. However, during low air flowing stage, the port 12 is closed by the wall of the carburetor body 1 and as the result, no ambient air is induced into the suction chamber 9 and the mixing chamber 5*a* via the port 12.

In operation, when an engine is rapidly accelerated during middle and high air flowing stages, the throttle valve 4 opens rapidly and as the result, induced air pulsation or pressure fluctuation is created in the air intake passage 3 and the venturi portion 5. The pressure fluctuation in the venturi portion 5 is transmitted through the vacuum communication port 9*a* of the suction piston 8 to the suction chamber 9, thereby creating sudden change in the negative pressure in the suction chamber 9. However, such a sudden change in the negative pressure is momentarily diffused through the pressure controlling port 12 of the suction piston 8 to the atmospheric pressure chamber 10. Thus, the suction piston 8 is not directly influenced by such a sudden change in the negative pressure, and excessive reciprocating motion of the suction piston 8 is prevented, without using a damping device, so as to achieve a moderate reciprocating motion of the suction piston 8. As a result of this, harmful self-oscillation of the suction piston due to the fluctuation in intake air vacuum may be prevented and air-fuel ratio may not become lean with no fluctuations, thereby enabling the engine to be smoothly driven. Furthermore, there is no possibility that the repeatability in accurate metering of fuel is reduced since no damping device is included in the carburetor.

Figures 8A, 8B:
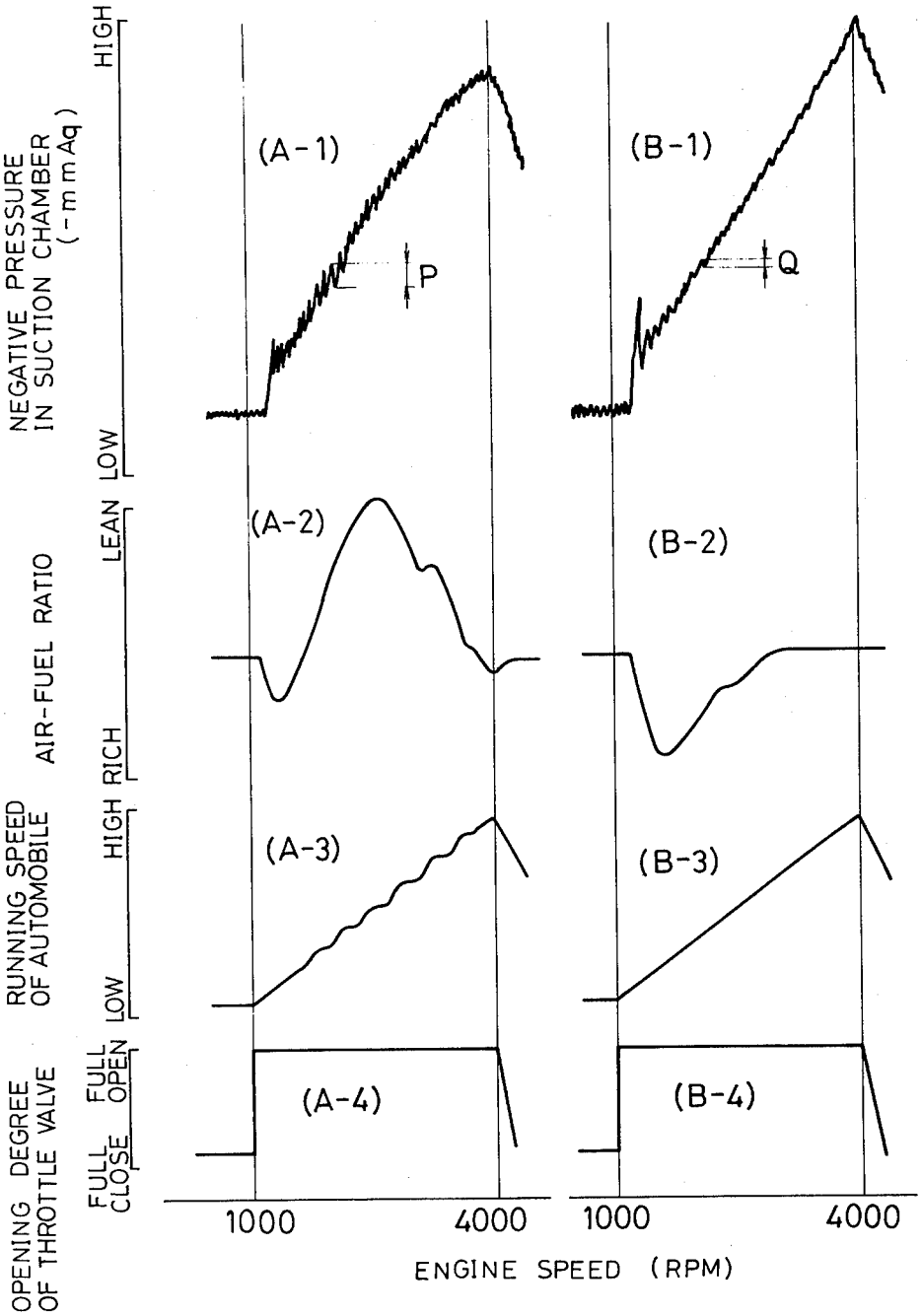
FIGS. 8A, 8B, 9A, 9B, 9C and 9D are graphical representations of operation according to the invention in comparison with a prior art.

FIG. 8A and 8B show characteristics of an engine including a conventional carburetor and an engine including the carburetor of the invention, in the case that the throttle valve is rapidly opened with the gear ratio of the associated transmission maintained at a constant value and the engine speed is accelerated from 1,000 to 4,000 RPM. In FIGS. 8A and 8B, the horizontal axis shows engine speed, and the vertical axis shows negative pressure in the suction chamber, air-fuel ratio, running speed of an automobile and opening degree of the throttle valve as viewed from top to bottom. On viewing FIG. 8B in comparison with FIG. 8A, the width of variation Q of the negative pressure in the suction chamber (B-1) is smaller than the width of variation P of the negative pressure (A-1), and the air-fuel ratio (B-2) is less leaner and is less varied than the air-fuel ratio (A-2). As is apparent from the running speed of an automobile (B-3) in comparison with (A-3), surging action of an automotive body, which is detected as a fluctuation in the running speed of an automobile during acceleration, is reduced.

As shown in FIGS. 2 and 3 illustrating the first preferred embodiment wherein the pressure controlling port 12 is provided at the lower peripheral wall of the suction piston 8 and in the same direction as the intake air flow direction, the pressure controlling port 12 communicates the suction chamber 9 with the mixing chamber 5*a* during low air flowing stage. When the throttle valve 4 is widely opened by a rapid accelerating operation, the negative pressure at the venturi portion 5 is rapidly increased. At this time, variation or increase in the negative pressure at the venturi portion 5 is transmitted through the vacuum communication port 9*a* to the suction chamber 9, and increase in the negative pressure in the mixing chamber 5*a* is transmitted through the pressure controlling port 12 to the suction chamber 9. Accordingly, the reciprocating motion of the suction piston 8 in response to the rapid accelerating operation during low air flowing stage is remarkably sensitive, thus improving the accelerating performance of the engine in comparison with conventional carburetors in which no pressure controlling port 12 is provided. Such a function is effective for normal acceleration and deceleration during low air flowing stage and the suction piston 8 sensitively responds to the variation in the negative pressure at the venturi portion 5 and the mixing chamber 5*a*, thereby allowing the amount of reciprocating motion to be determined with high degree of accuracy and the air-fuel ratio to be maintained at a constant value.

Figure 9D:
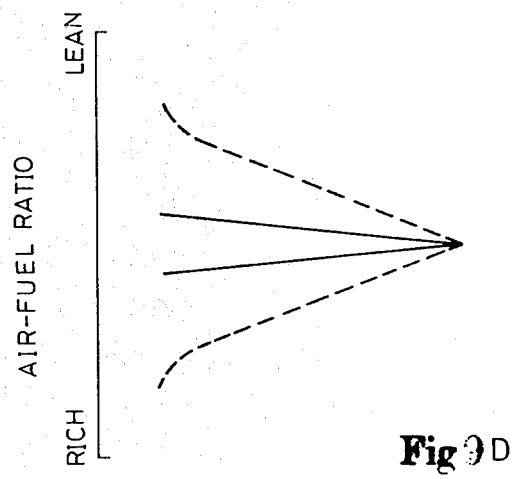
Figure 9A:
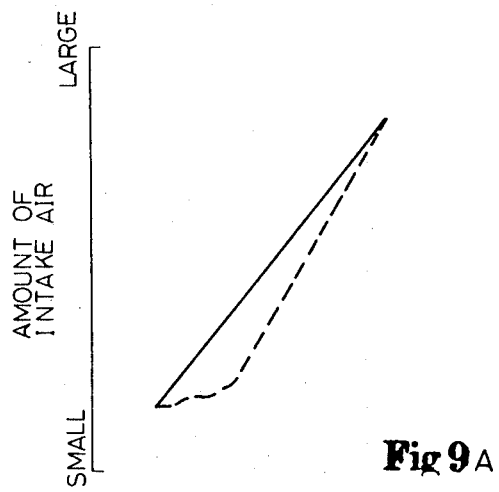
Figure 9C:
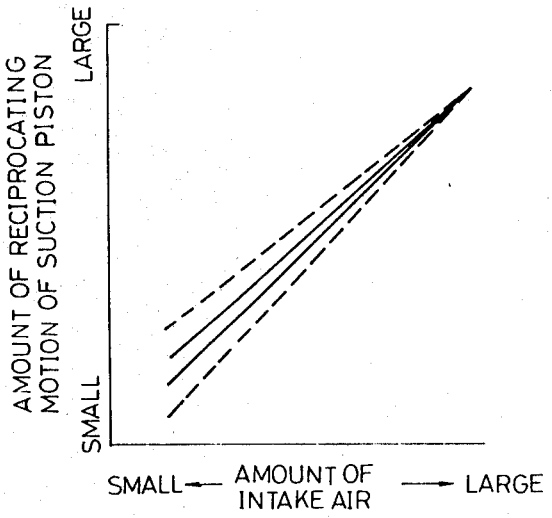
Figure 9B:
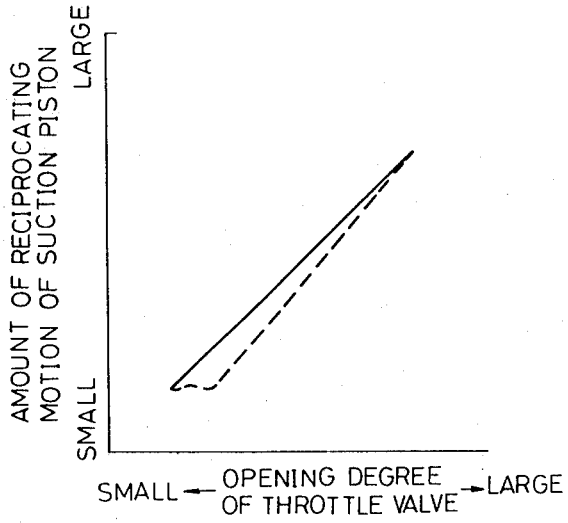

FIGS. 9A and 9B show the relation between the opening degree of the throttle valve and the amount of intake air, and the relation between the opening degree of the throttle valve and the amount of reciprocating motion of the suction piston, respectively, in connection with the first preferred embodiment of the invention (solid line) and the prior art (dotted line).

FIGS. 9C and 9D show the relation between the amount of intake air and the amount of reciprocating motion of the suction piston, and the relation between the amount of intake air and the air-fuel ratio, respectively, in connection with the first preferred embodiment of the invention (solid line) and the prior art (dotted line). As is apparent from FIG. 9D, errors in the air-fuel ratio with respect to the small amount of intake air in the invention is widely decreased in comparison with those in the prior art.

Figure 6:
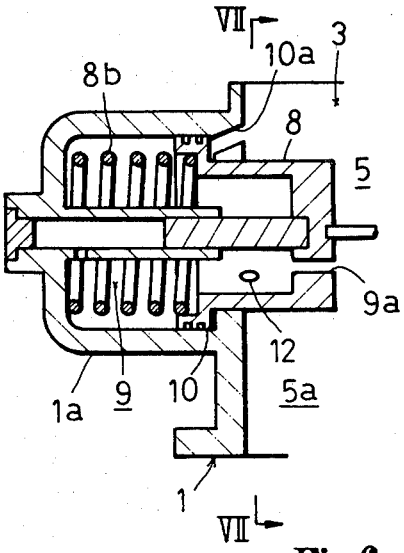
Figure 7:
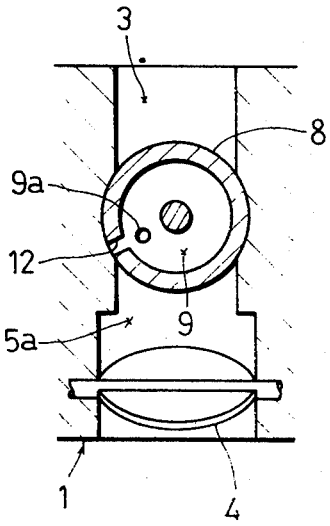

As shown in FIGS. 6 and 7 illustrating the second preferred embodiment, wherein the pressure controlling port 12 is provided at the lower peripheral wall of the suction piston 8 and is located at an angle to the intake air flow line, the pressure controlling port 12 is closed by the wall of the carburetor body 1 during low air flowing stage and as the result, only the negative pressure at the venturi portion 5 is transmitted to the suction chamber 9. Accordingly, in this embodiment, reciprocating motion of the suction piston 8 is not delayed, which may occur in the conventional carburetor including a pressure controlling port provided at the sliding flange of the suction piston. Variations in the amount of reciprocating motion of the suction piston, which are caused by such errors as created during manufacture of the pressure controlling port, are minimized.

Although some preferred embodiments of the invention have been disclosed and described, it is apparent that other embodiments and modifications of the invention are possible within the scope of the appended claims.

What is claimed is:

1. In combination with a variable venturi carburetor for an internal combustion engine having a carburetor body, a float chamber, an air intake passage, a venturi portion provided in said air intake passage, a fuel passage communicating with said float chamber and said venturi portion, a fuel jet provided in said fuel passage, a suction piston transversely movable with respect to said venturi portion in response to the load conditions of the engine and adapted to be slidably inserted into a cylindrical portion of said carburetor body, a suction chamber defined by an inside wall of said cylindrical portion and a flange portion of said suction piston, an atmospheric pressure chamber defined by said flange portion of said suction piston and said carburetor body, a mixing chamber defined between said venturi portion and a throttle valve, and a fuel metering needle fixed to the end of said suction piston at its base portion and having a free end for controlling the annular opening area of a fuel metering portion of said fuel jet by reciprocating motion of said suction piston; the improvement comprising a pressure controlling port provided at the lower peripheral portion of said suction piston, said pressure controlling port being located at such a position as to communicate with said suction chamber and said atmospheric pressure chamber during middle and high intake air flowing stages.

2. The improvement as defined in claim 1, wherein said pressure controlling port is located at such a position as to communicate with said suction chamber and said mixing chamber during low intake air flowing stage.

* * * * *